US010624189B1

(12) United States Patent
Wang

(10) Patent No.: US 10,624,189 B1
(45) Date of Patent: Apr. 14, 2020

(54) BRIGHTNESS ADJUSTMENT FOR A WHITE-LIGHT LAMP

(71) Applicant: Tiejun Wang, Lin'an (CN)

(72) Inventor: Tiejun Wang, Lin'an (CN)

( * ) Notice: Subject to any disclaimer, the term of this patent is extended or adjusted under 35 U.S.C. 154(b) by 0 days.

(21) Appl. No.: 16/504,490

(22) Filed: Jul. 8, 2019

(51) Int. Cl.

| | |
|---|---|
| ***H05B 37/02*** | (2006.01) |
| ***H05B 33/08*** | (2020.01) |
| ***F21V 23/00*** | (2015.01) |
| ***H05B 45/20*** | (2020.01) |
| ***H05B 47/10*** | (2020.01) |
| ***H05B 45/46*** | (2020.01) |
| ***H05B 45/00*** | (2020.01) |
| ***H05B 47/19*** | (2020.01) |
| ***H05B 47/105*** | (2020.01) |
| ***H05B 45/48*** | (2020.01) |
| ***H05B 45/10*** | (2020.01) |

(52) U.S. Cl.
CPC ..... *H05B 45/20* (2020.01); *F21V 23/001* (2013.01); *F21V 23/003* (2013.01); *H05B 45/00* (2020.01); *H05B 45/10* (2020.01); *H05B 45/46* (2020.01); *H05B 45/48* (2020.01); *H05B 47/10* (2020.01); *H05B 47/105* (2020.01); *H05B 47/19* (2020.01)

(58) Field of Classification Search
CPC .. H05B 33/0857; H05B 33/086; H05B 37/02; H05B 33/0845; H05B 37/0281; H05B 33/0806; H05B 33/0827; H05B 45/20; H05B 45/10; H05B 47/10; H05B 45/00; H05B 47/19; H05B 45/46; H05B 45/48; H05B 45/60; H05B 47/105; F21Y 2115/10; F21K 9/00; F21V 23/001; F21V 23/003
See application file for complete search history.

(56) References Cited

U.S. PATENT DOCUMENTS

| | | | | |
|---|---|---|---|---|
| 8,508,141 | B2 * | 8/2013 | Takeda | H05B 33/086 315/192 |
| 9,730,291 | B1 * | 8/2017 | Janik | H05B 33/086 |
| 10,299,321 | B1 * | 5/2019 | Trask | H05B 33/0863 |
| 10,420,183 | B2 * | 9/2019 | Yamakawa | F21S 2/00 |
| 10,470,262 | B2 * | 11/2019 | Li | H05B 33/0854 |
| 2012/0099303 | A1 * | 4/2012 | Li | H01L 25/0753 362/231 |
| 2016/0276549 | A1 * | 9/2016 | Yamashita | G02B 6/0091 |
| 2018/0376555 | A1 * | 12/2018 | Wang | H05B 33/0845 |
| 2019/0371768 | A1 * | 12/2019 | You | H01L 25/0753 |

* cited by examiner

*Primary Examiner* — Vibol Tan
(74) *Attorney, Agent, or Firm* — Daniel M. Cohn; Howard M. Cohn

(57) ABSTRACT

A controller provides power to (i) a first light-emitting device that emits a first white light of a first correlated color temperature (CCT) and (ii) a second light-emitting device that emits a second white light of a second CCT lower than the first CCT. The first and second white lights mix to yield a combined white light having a combined-light CCT with a combined-light brightness. The controller receives electrical supply power in the form of segments of power. The controller distributes the supply power to the first and second light-emitting devices according to a power-distribution scheme that differentiates between whether segment duration of the segments is in an upper range or a lower range such that: (i) throughout the upper range: as segment duration decreases, combined-light CCT decreases and combined-light brightness remains substantially constant, and (ii) throughout the lower range: as the segment duration decreases, combined-light brightness decreases.

20 Claims, 5 Drawing Sheets

DIMMER INPUT

DIMMER OUTPUT

DIMMER OUTPUT

DIMMER OUTPUT

BRIGHTNESS ADJUSTMENT FOR A WHITE-LIGHT LAMP

FIELD OF THE INVENTION

This relates to an apparatus and method of varying the brightness and correlated color temperature (CCT) of a white light lamp.

BACKGROUND

A TRIAC light dimmer is used to adjust power that is supplied to a lamp in order to adjust the brightness (amount of light) emitted by the lamp. An incandescent lamp's illumination is based on thermal radiation. Therefore, both output brightness and correlated color temperature (CCT) of an incandescent lamp's emitted light is a positive function of the lamp's input power, in that both brightness and CCT increase with increasing input power and decreases with decreasing power.

SUMMARY

A controller provides power to (i) a first light-emitting device that emits a first white light of a first correlated color temperature (CCT) and (ii) a second light-emitting device that emits a second white light of a second CCT. The second CCT is lower than the first CCT. The first and second white lights mix to yield a combined white light having a combined CCT with a combined brightness. The controller receives electrical supply power in the form of segments of power. The controller distributes the supply power to the first and second light-emitting devices according to a power-distribution scheme that differentiates between whether segment duration of the segments is in an upper range or a lower range, as follows: (i) In the upper range: as segment duration decreases, combined-light CCT decreases and combined-light brightness remains constant. (ii) In the lower range: as the segment duration decreases, combined-light brightness decreases.

The power-distribution scheme might further differentiate between whether segment duration is in an upper portion of the lower range or a lower portion of the lower range, as follows: (i) In the upper portion of the lower range: as the segment duration decreases, the first brightness decreases, the second brightness remains constant, and the combined-light CCT decreases. (ii) In the lower portion of the lower range: as the segment duration decreases, the first brightness remains constant, and the second brightness decreases, and the combined-light CCT remains constant.

Electrical current applied by the controller to the first and second light-emitting devices are respectively first current and second current. The sum of the first and second currents is combined current. The power-distribution scheme might further include the following: (i) In the upper range: as the segment duration decreases, the first current decreases, the second current increases, and the combined current remains constant. (ii) In the lower range: as the segment duration decreases, the combined current decreases.

The power-distribution scheme might further include the following: In the upper portion of the lower range: (i) As the segment duration decreases, the first current decreases, and the second current remains constant. (ii) And in the lower portion of the lower range: as the segment duration decreases, the first current remains constant, and the second current decreases.

Electrical powers applied by the controller to the first and second light-emitting devices are respectively first power and second powers. The sum of the first and second powers is combined power. The power-distribution scheme might further include the following: (i) In the upper range: as the segment duration decreases, the first power decreases, the second power increases, and the combined power remains constant. (ii) In the lower range: as the segment duration decreases, the combined power decreases.

The power-distribution scheme might further include the following: (i) In the upper portion of the lower range: as the segment duration decreases, the first power decreases, and the second power remains constant. (ii) In the lower portion of the lower range: as the segment duration decreases, the first power remains constant, and the second power decreases.

The lower range might be contiguous with the upper range.

The segments might be segments of an alternating current (AC) wave, such that the duration corresponds to a cycle-based angular range over which each segment extends.

A lamp housing might support the first and second light-emitting devices in positions relative to each other such that the first white light will mix with the second white light to yield the combined white light. The first light-emitting device might comprise one or more LEDs, and the second light-emitting device might comprise one or more LEDs.

The first CCT might be in the range 4000K to 7000K. The second CCT might be in the range 1500K to 3000K. The combined-light CCT might be: in the range 4500K to 6500K when the segment duration is at a top of the upper range, in the range 2500K to 3500K when the segment duration is at the bottom of the upper range and the top of the lower range, and in the range 1500K to 2500K when the segment duration is at a bottom of the lower range.

A dimmer might provide the input supply power to the controller and include a user-interface component through which a user can adjust the segment duration of the input supply power. The user-interface component might be a physical component that is configured to be manually moved by a user to adjust the segment duration. The lamp housing might be in the form of a canister light fixture for recessed lighting, and the user-interface component might be located at a top of the lamp housing which is configured to be hidden behind a surface of a ceiling when the lamp housing is mounted in the ceiling.

BRIEF DESCRIPTION OF THE DRAWINGS

The structure, operation, and advantages of the present invention will become further apparent upon consideration of the following description taken in conjunction with the accompanying figures (FIGs.). The figures are intended to be illustrative, not limiting.

Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

Figure 1:
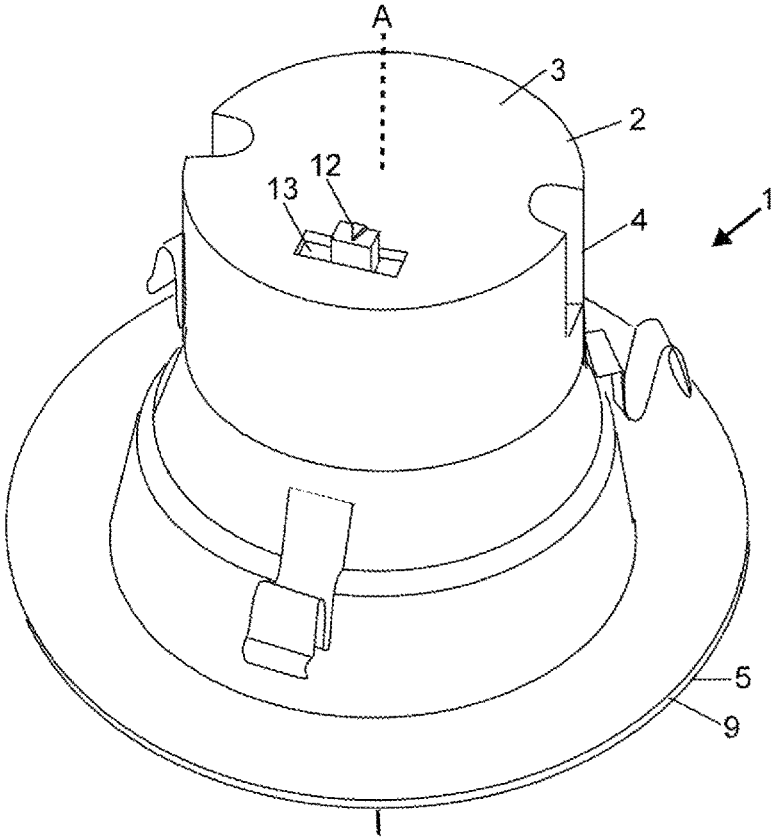

Often, similar elements may be referred to by similar numbers in various figures (FIGs) of the drawing, in which case typically the last two significant digits may be the same, the most significant digit being the number of the drawing figure (FIG). Furthermore, for clarity, some reference numbers may be omitted in certain drawings.

FIG. 1 is a perspective view of an example lighting device.

Figure 2:
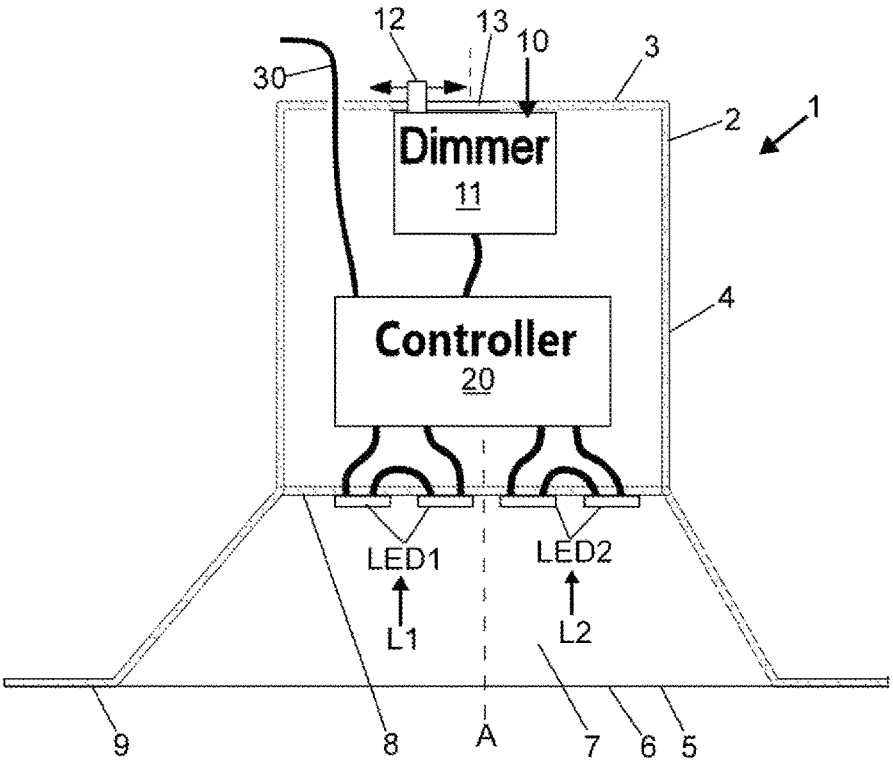

FIG. 2 is a side sectional view of the light device.

Figure 3:
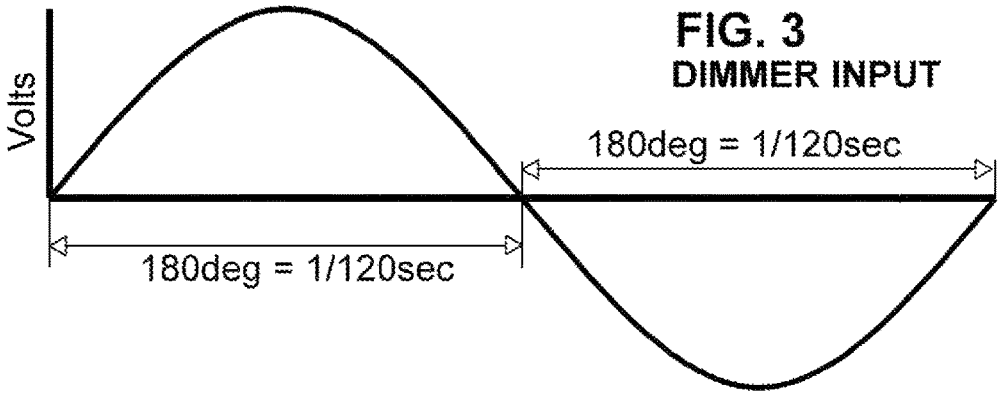

FIG. 3 is a graph of voltage versus time of an example single cycle of mains supply power that a dimmer might input.

Figure 4:
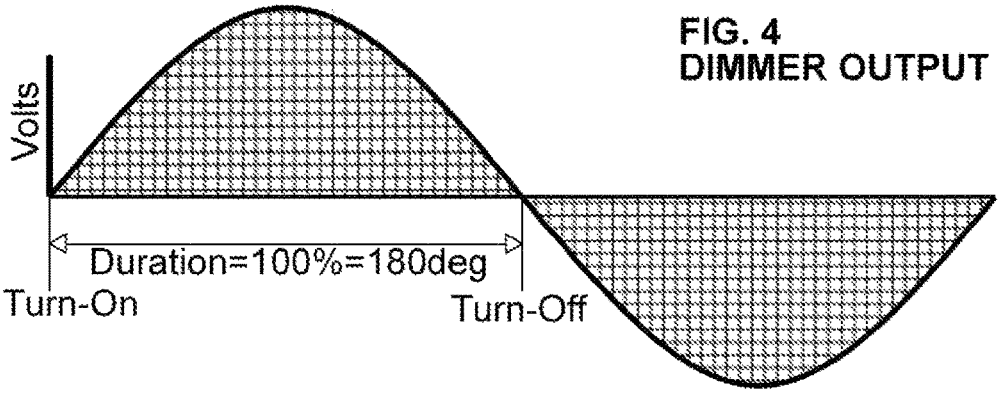
Figure 5:
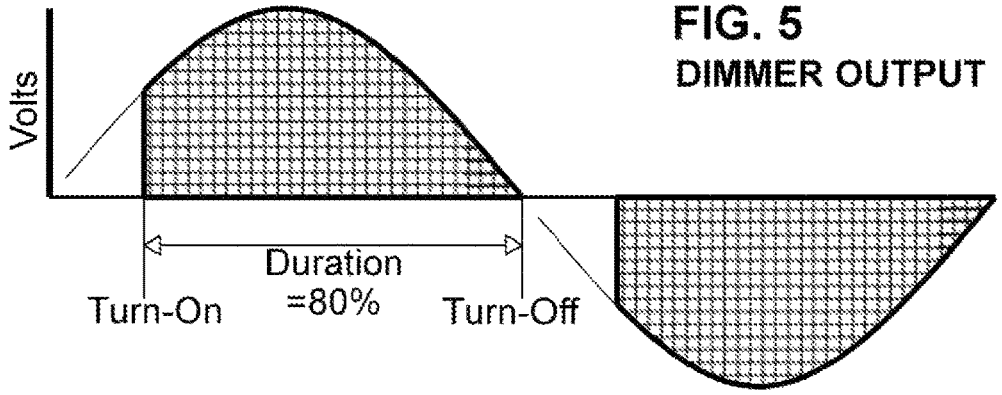
Figure 6:
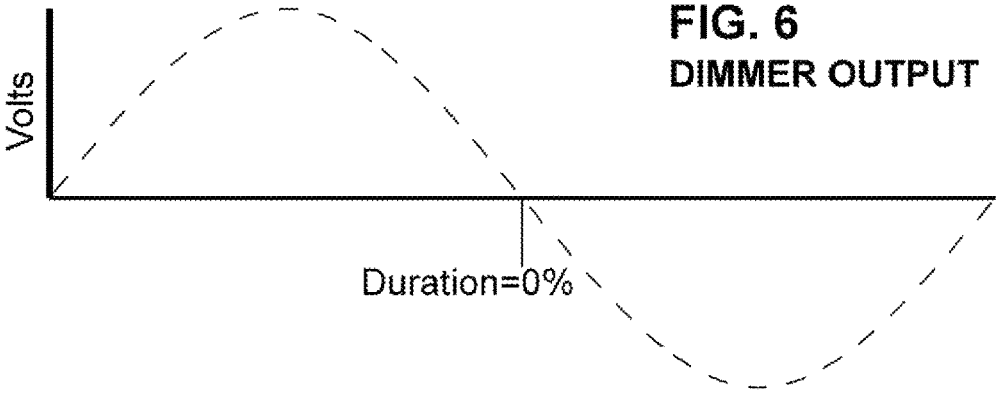

FIGS. 4-6 are example voltage traces of input supply power that the dimmer might output to a controller.

Figure 7:
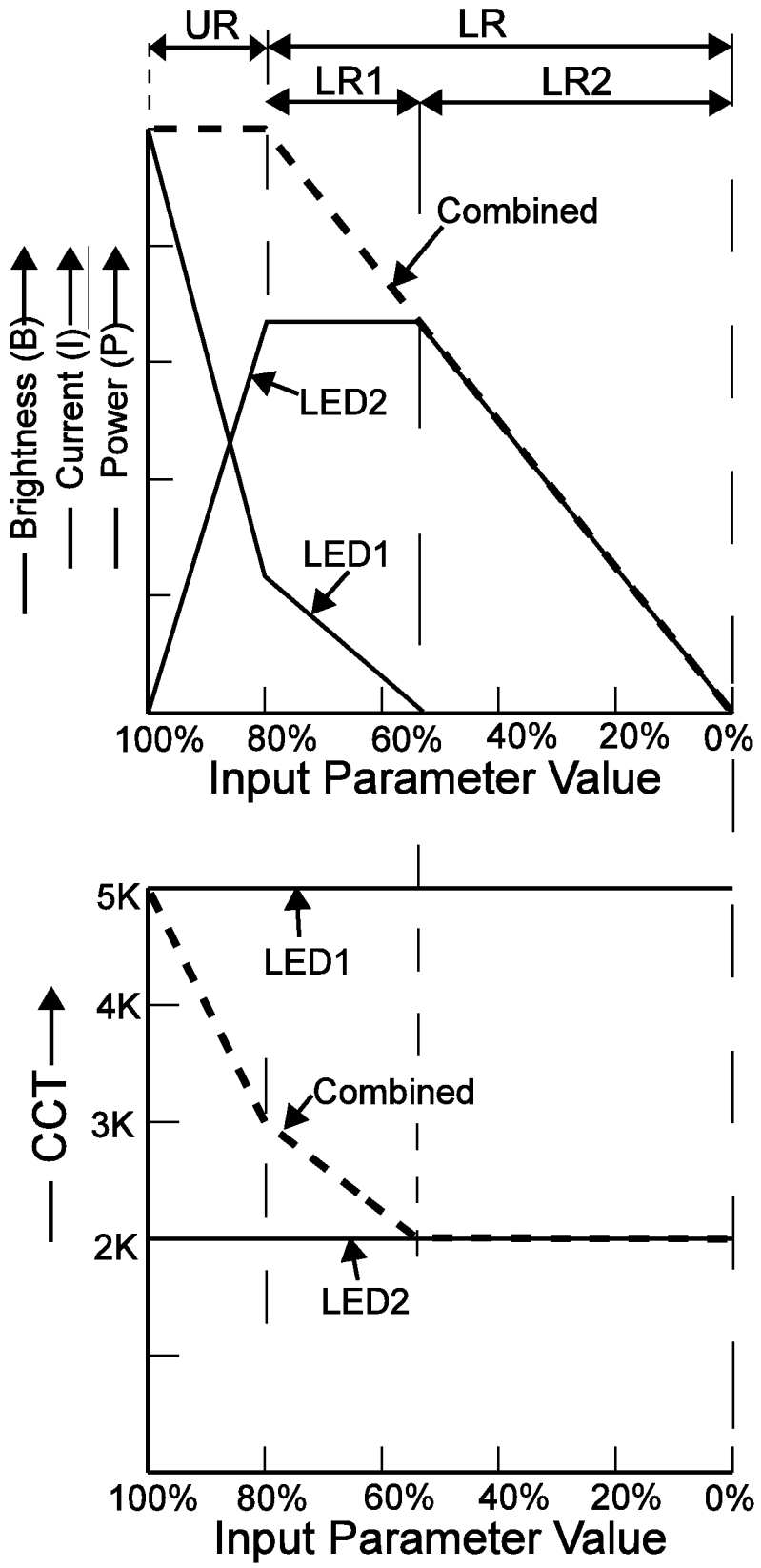

FIG. 7 shows graphs illustrating an example power-distribution scheme for apportioning power to different light-emitting devices of the lamp as a function of a characteristic of the input supply power.

Figure 8:
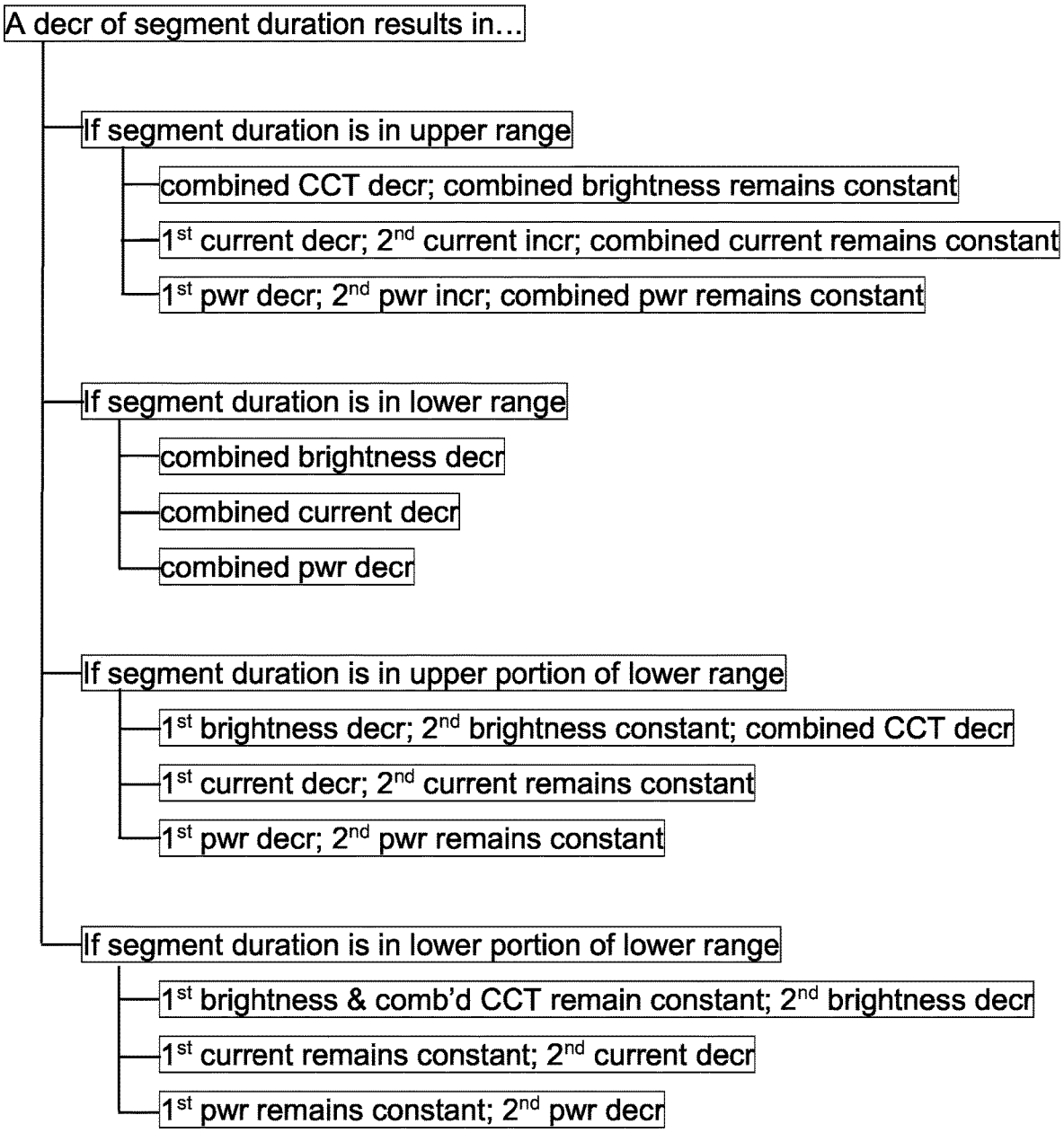

FIG. 8 is a flow chart of a method that the controller might perform to implement the power distribution scheme.

Figure 9:
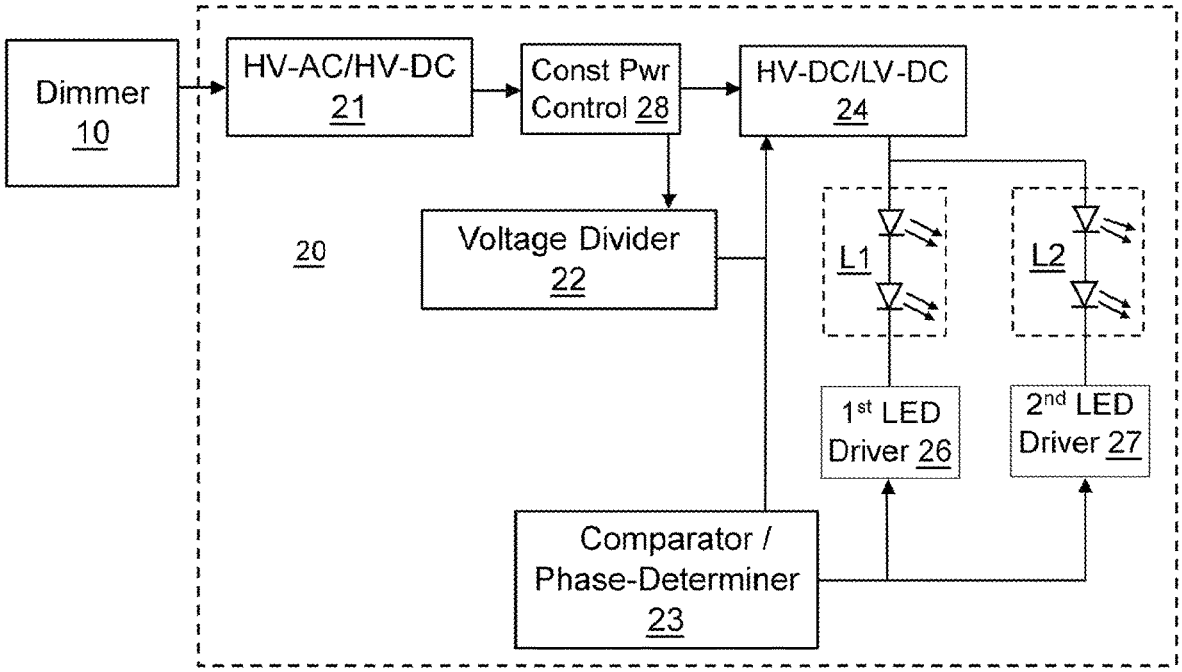

FIG. 9 is an example block diagram, of an electrical circuit, configured to implement the power-distribution scheme.

DETAILED DESCRIPTION

FIGS. 1-2 show an example lighting device 1. In this example, the lighting device 1 is a recessed can light (canister light fixture). The lighting device 1 is configured to be installed in a hole in a ceiling.

In the following description of the lighting device 1, directional terms (e.g., vertical, horizontal, top, and bottom) are made with reference to a typical installed orientation of the lighting device 1.

The lighting device 1 has a lamp housing 2 that is centered on an imaginary vertical central axis A. The lamp housing 1 has a top defined by a horizontal flat top surface 3. The housing 2 has a side surface 4 that includes a substantially-cylindrical upper section and a frustoconical (flared) lower section. The lamp housing 2 has a bottom 5 with a round bottom-opening 6. The bottom opening 6 opens to a light cavity 7 in the housing 2. In the light cavity 7, a first light-emitting device L1 and a second light-emitting device L2 are mounted to an internal surface 8 in the housing 2. The first and second light-emitting devices L1, L2 emit light that exits the cavity 7 through the bottom opening 6 and is directed downward from the ceiling. The bottom opening 6 is surrounded and bounded by an annular flange 9 that extends radially outward from the bottom opening 6. The top surface 3, the side surface 4, the bottom opening 6, and the flange 9, and are all centered on the vertical central axis A.

In this example, the first light-emitting device L1 is configured to emit a first white light of a first correlated color temperature (CCT). The second light-emitting device L2 is configured to emit a second white light of a second CCT that is lower than the first CCT. In this example, each of the first and second light-emitting devices L1, L2 is an LED device. Each LED device comprises one or more LEDs (LED1, LED2). In this example, each LED device L1, L2 comprises a string of LEDs (LED1, LED2) electrically connected in series. Each LED's CCT tends to remain constant over a wide operational range of powers (current) applied to the respective LED.

The lamp housing 2 supports the first and second light-emitting devices L1, L2 in positions relative to each other such that the first white light emitted by the first LED device L1 will mix with the second white light emitted by the second LED device L2 to yield a combined white light that has a combined CCT with a combined brightness.

The combined white light exits the cavity 7 through the bottom opening 6. To let the combined white light pass through the bottom opening 6, the bottom opening might be uncovered or, alternatively, might be covered by a transparent covering or translucent covering (not shown).

The lighting device 1 in this example includes a light-adjustment device 10 for adjusting characteristics (e.g., brightness and CCT) of combined white light emitted by the lighting device 1. The light-adjustment device 10 in this example is user adjustable, in that it can be adjusted manually (i.e., by a person). In this example, the light-adjustment device 10 is a user-adjustable dimmer 10.

The dimmer 10 includes a dimmer base 11 that is located inside the lamp housing 2. The dimmer base 11 is mounted to, and thus fixed relative to, the lamp housing 2.

The dimmer 10 (light-adjustment device) further includes a user-interface component 12. The user-interface component 12 in this example is a protrusion that protrudes upward, from the dimmer base 11, through a slot 13 in the lamp housing's top surface 3. Accordingly, the user-interface component 12, along with the top of the lamp housing 2, is hidden in a ceiling (i.e., above the ceiling surface) when the light fixture is mounted in the ceiling through a hole in the ceiling surface. The user-interface component 12 is user-adjustable in that it can be moved by a user (e.g., by a finger) across an operational full-scale range from a first end of the operational range to an opposite second end of the operational full-scale range. This range is "operational full-scale" in that it defines the full scale of positions and values that the dimmer 10 is capable of providing when the dimmer is operating as intended and designed.

In this example, the protrusion is a slider and the positional movement is linear, in that the user can slide the protrusion linearly (in a straight line) along a range of positions (positional range) from the first end of the linear positional full-scale range to the opposite second end of the linear positional full-scale range, and vice versa (i.e., from the second end back to the first end). The first and second ends of the positional operational full-scale range in this example are, respectively, at or near the opposite ends of the slot 13. The range is "positional" in that it refers to a range of positions that the slider can be moved to.

In another example, the protrusion might be a rotatable knob and the positional movement is rotational (instead of linear). The knob might project from the dimmer base 11 and be moved rotationally (i.e., turned) by the user's fingers along a range of angular positions (angular positional range) from a first end of an angular positional full-scale range (e.g., fully counterclockwise) to a second end of the angular positional full-scale range (e.g., fully clockwise), and vice versa.

In the above examples, the user-interface components (slider and knob) are physical components that can be grasped and moved by a user. In other examples, the user-interface component is instead displayed, such as on a display screen. An example of a displayed user-interface component is a virtual component, i.e., an image (e.g., on a touch screen) that simulates a physical component, such as a virtual (displayed image of) a slider or a knob. Virtual user-adjustable components might be moved by the user swiping the virtual component on a touch screen or by the user grabbing-and-moving the virtual component with a mouse.

Another example of a displayed user-interface component is a displayed bar graph, in which the number of bars that are lit indicates a value that is user-selected (user-adjusted) by, for example, using a displayed up-arrow and a displayed down-arrow Another example of a displayed user-interface component is a numeric display whose displayed number indicates a value that is user-adjustable by, for example, using a displayed up-arrow and a displayed down-arrow. The numeric display is, unlike the other examples above, not "positional" in that the user-selected value it indicates is not defined by its position.

In each of the above examples, a value indicated by the physical or displayed user-interface component is user-adjustable across a predetermined operational full-scale range, from a first end of the range to a second end of the range.

In the examples of a numeric display and a bar graph, the user-selectable positions are discrete and finite in number and spaced apart along the length of the range, from the full-scale range's first end to the full-scale range's second end. In the example of a numeric display, the first and second ends of the full-scale range might respectively be 100 and zero, with the numerical value being user-adjustable between a finite number (e.g., 101) of discrete values between (and including) 100 and zero. In the example of a ten-bar bar graph, the first and second ends of the operational full-scale range might respectively be ten bars lit and zero bars lit, with the number-of-bars lit being a finite number (e.g., eleven) of discrete values between (and including) ten and zero.

Alternatively, as in the examples of a physical linear slider and physical rotary knob, the number of positions that can be user-selected in the operational range might be substantially (as it appears to the user) infinite, so that the user-interface component 12 is continuously-variable in terms of position, and the user-adjustable component 12 is moveable to any position between the first and second ends of the operational range.

In any of the example user-interface components described above, the user-interface component's output value may be expressed as a percentage, from 0% through 100%, in which 0% corresponds to the second end of the full-scale range and 100% corresponds to the first end of the full-scale range.

The user-adjustable light-adjustment device 10 in this example is a TRIAC dimmer in that its base 11 includes a circuit that includes a TRIAC. The TRIAC dimmer in this example inputs electrical supply power (electrical current) in the form of an AC (alternating current) input supply voltage, which in this example is a mains (wall power) 120V 60 Hz electrical supply.

Within the dimmer 10, the TRIAC inputs an alternating electrical current at its input terminal. When the TRIAC is triggered by a positive or negative trigger voltage applied to the TRIAC's gate, the TRIAC starts to conduct the input current to the TRIAC's output. The TRIAC continues to conduct even after the trigger voltage ceases. The conduction ceases when the input current drops below a holding current level which can be substantially near zero current. Thus, within a half-cycle in either direction of current, the TRIAC is in a conducting state from the time it receives the gate trigger until the end of the half-cycle. Within a half-cycle, the earlier the controller applies the trigger, the greater the conduction-time during that half-cycle, and therefore the greater the current and power applied to the lamp, and therefore the greater the lamp's brightness. The TRIAC dimmer includes a TRIAC controller that controls the power applied to the lamp by controlling the time at which the trigger is applied.

FIG. 3 shows a graph of voltage versus time of an example of a single cycle of mains supply power. The cycle corresponds to 360 degrees (deg) and lasts 1/60 second (sec). Accordingly, each half-cycle of input voltage/current corresponds to 180 deg and has a duration of 1/120 sec.

FIGS. 4-6 illustrate examples of different voltage traces of supply power that the dimmer 10 is configured to output. The dimmer 10 outputs only a segment of each half-cycle of the AC mains supply. Each output segment ends at, or substantially at, the end of the half-cycle (labelled "Turn-Off" in the figures) when the TRIAC turns off, which corresponds to 180 deg. Each output segment starts at a point in time (labelled "Turn-On" in the figures) when the TRIAC turns on. The Turn-On point is located at a point within the half-cycle, correlating to a cycle-angle between 0 deg and 180 deg, that is selected (controlled) by the user through the user-interface component 12.

FIG. 4 shows an example in which the user-interface component 12 is at the first end of the operational full-scale range. This causes the TRIAC's Turn-On point, and thus the output segment's starting point, to be about 0 deg. So, the output segment's duration is about 180 deg, which corresponds to 100% of the half-cycle and about 1/120 sec.

FIG. 5 shows an example in which the user-interface component 12 is at an intermediate position about 80% of the way from the second end of the full-scale range to the first end of the full-scale range. This causes the TRIAC's Turn-On point to be about 20% of the way through the 180 deg half-cycle. So, the TRIAC is on for a duration of only 80% of the 180 deg half-cycle, corresponding to 1/150 sec (which is 80% of the 1/120 sec half-cycle).

FIG. 6 shows an example in which the user-interface component 12 is at the second end of the full-scale range. This causes the TRIAC's Turn-On point to be at the end of the half-cycle which coincides with the Turn-Off point, so that the output segment's duration is about 0 deg and about 0 sec.

As shown in FIGS. 4-6, the output segment's duration (in terms of time in seconds or cycle-angle in degrees) is a function of the user-interface component's value. And the user-interface component's value corresponds to the component's position or number-of-bars-lit or displayed number. As the user-interface component's position progresses from the first end, through the full-scale range, to the second end, the output supply's segment duration progresses from 180 deg down to 0 deg and from 1/120 sec down to 0 sec. Conversely, as the user-interface component's position progresses from the second end, through the full-scale range, to the first end, the dimmer's supply's segment duration progresses from 0 deg up to 180 deg and from 0 sec up to 1/120 sec. In this example, the segment duration is continuously-variable, and the position of the user-interface component 12 is continuously-variable, for the segment duration to be a smoothly-continuous monotonic function of the user-interface component's position.

The lighting device 1 includes a controller 20. The controller 20 inputs the dimmer's electrical output power, which is "input" supply power from the viewpoint of the controller. The controller 20 distributes (apportions) that input supply power to the lamp's LED devices L1, L2 in a way described in the following paragraphs.

The controller 20 differentiates between whether segment duration (of the input supply power) is in an upper range or a lower range. The upper range might have a top end corresponding to a predetermined value of perhaps 100% of the half-cycle's duration (i.e., 180 deg). The upper range might be (at least substantially) at, or spaced from, the first end of the operational positional range of the user-interface component 12. The upper range might have a bottom end corresponding to a predetermined midpoint of the half-cycle duration, perhaps between 30% and 90% of the half-cycle's duration. The midpoint in this example is 80% of the half-cycle's duration.

In this example, the lower range is contiguous with the upper range, in that the lower range has a top end that is (at least substantially) the same as the bottom of the upper range. Alternatively, the lower range might not be contiguous with the upper range. The lower range might be between 30% and 90% of the half-cycle's duration. In this example, the top of the lower range equals the bottom of the upper range which is 80% of the half-cycle's duration. The top end of the upper range might be (at least substantially) at, or below, the top end of the operational full-scale output range of the dimmer 10. The bottom end of the lower range might be (at least substantially) at, or above, the bottom end of the operational full-scale output range of the dimmer 10.

The controller 20 distributes (apportions) the input supply power to the first and second light-emitting devices L1, L2 according to a power-distribution scheme.

FIG. 7 provides an example of the power-distribution scheme. FIG. 7 includes graphs that illustrate an example of how brightness (B), current (I), power (P), and correlated-color temperature (CCT) might be a function of a characteristic (in this example segment duration) of the input supply power. In the present examples, B, I, and P are proportional to each other, so that a single graph in FIG. 7 suffices to characterize all of them. All percentages in the X-axes of FIG. 7 are in terms of a half-cycle of the input supply power. So, for example, a segment duration of 100% means the segment lasts the entire half-cycle—i.e., a full 180 deg.

The power-distribution scheme is explained below with reference to the following terms: Brightnesses emitted by the first and second light-emitting devices L1, L2 are respectively called first brightness and second brightness. Brightness of the combined light is called combined brightness. Electrical current and power that are supplied by the controller 20 to the first light-emitting device L1 are respectively called first current and first power. Electrical current and power supplied by the controller 20 to the second light-emitting device L2 are respectively called second current and second power. The sum of the electrical currents and the sum of the electrical powers supplied by the controller 20 to both the first and second light-emitting devices L1, L2 are respectively called combined current and combined power.

The controller 20 receives input supply power from the dimmer 10. The controller 20 might determine whether a characteristic of the input supply power—in the example segment duration—is in an upper range (UR) or a lower range (LR) and, further, whether the characteristic is in an upper portion of the lower range (LR1) or in a lower portion (LR2) of the lower range (LR). In the example of FIG. 7, UR extends from 100% down to 80%, LR extends from 80% down to 0%, LR1 extends from 80% to about 55%, and LR2 extends from about 55% down to 0%. Where the above percentages are in terms of operational full-scale of the input parameter (which in this example is segment duration).

If/when the segment duration is in the upper range (UR), as segment duration decreases: (A1) the combined CCT decreases and the combined brightness remains constant; and/or (A2) the first current decreases, the second current increases, and the combined current remains constant; and/or (A3) the first power decreases, the second power increases, and the combined power remains constant.

If/when segment duration is in the lower range (LR), as segment duration decreases: (B1) the combined brightness decreases; and/or (B2) the combined current decreases; and/or (B3) the combined power decreases.

If/when segment duration is in the upper portion (LR1) of the lower range, as segment duration decreases: (C1) the first brightness decreases, the second brightness remains constant, and the combined CCT decreases; and/or (C2) the first current decreases, and the second current remains constant; and/or (C3) the first power decreases, and the second power remains constant.

If/when segment duration is in the lower portion (LR2) of the lower range, as segment duration decreases: (D1) the first brightness remains constant (in this example zero), the second brightness decreases, and the combined CCT remains constant; and/or (D2) the first current remains constant, and the second current decreases; and/or (D3) the first power remains constant, and the second power decreases.

The above example scheme includes steps in which a parameter "remains constant". In a related example scheme, those steps might specify that the parameter "remains substantially constant."

FIG. 8 is a flow chart illustrating a method that the controller 12 would implement if all of the overmentioned steps (A1-A3, B1-B3, C1-C3, D1-D3) would happen to be implemented. FIG. 8 uses the following abbreviations: "pwr" to mean power; "incr" and "decr" to mean increases and decreases respectively, "$1^{st}$ brightness" to mean first light-emitting device's brightness; and "$2^{nd}$ brightness" to mean second light-emitting device's brightness.

Logic steps (A1-A3, B1-B3, C1-C3, D1-D3) of the power-distribution method might be performed by a processor-based device, such as a microcontroller executing program code. In other examples, the steps might be performed by electrical circuitry using discrete components.

Example characteristics for the lighting device 1 might be the following: The first CCT is in the range 4000K to 7000K, such as 5000K. The second CCT is in the range 1500K to 3000K, such as 2000K. Combined CCT is in the range 4500K to 6500K, such as 5000K, when segment duration is at the top of the first range. Combined CCT is in the range 2500K to 3500K, such as 3000K, when segment duration is at the bottom of the first range and the top of the second range. Combined CCT is in the range 1500K to 2500K, such as 2000K, when the segment duration is at the bottom of the second range. The dimmer's full operational range of segment duration might extend from 180 deg down to 0 deg, corresponding to 100% of the half-cycle duration down to 0% of the half-cycle duration. The upper range of segment duration might extend from 100% of the half-cycle duration down to 80% of the half-cycle duration. The lower range of segment duration might extend from 80% of the half-cycle duration down to 0% of the half-cycle duration.

In the above examples, a power cable 30 conducts mains power into the lamp housing 2 and to the dimmer 10 (light-adjustment device) which is in the lamp housing 2. Alternatively, the dimmer 10 might be remote from the lamp housing 2 and installed in an electrical box in a wall, so that one power cable conducts mains power to the dimmer 10, and another cable conducts the dimmer's output to the controller 20 which is in the lamp housing 2.

In the above examples, the segmented input power is supplied by a TRIAC dimmer 10. Alternatively, the segmented input power might be supplied by a dimmer that is not based on a TRIAC, or by a device that is not a dimmer.

In the above examples, the controller 20 is mounted in the same housing 2 as are the first and second light-emitting devices L1, L2. Alternatively, the controller 20 might be remote from the light-emitting devices L1, L2 and might also be remote from the dimmer 10.

In the above examples, the dimmer 10 outputs supply power (to power the LEDs) that is segmented, and the "Input Parameter Value" (mentioned in FIG. 7) that the power distribution scheme (to the LEDs) is based on is the supply power's segment duration. In another example, the dimmer 10 outputs supply power (to power the LEDs) that is continuous (i.e., not segmented) and whose voltage level is a function of the user-interface selection. And the "Input Parameter Value" (mentioned in FIG. 7) that the power distribution scheme is based on is the supply power's voltage level. In that case, in the above paragraphs and FIG. 8 describing the power distribution scheme, the term "voltage level" would replace the term "segment duration". And the upper and lower ranges would be ranges of voltage (instead of ranges of duration).

In the above examples, the power-distribution scheme is expressed in terms the input parameter value (e.g., segment length or voltage level) that is an electrical characteristic of the supply power. In another example, the power distribution scheme can be expressed in terms of the input parameter value that is a user-interface indication that is a seen by the user; for example the number displayed by a user-controlled numeric display, or the number of bars that are lit on a user-controlled bar graph, or the angular position of a user-controlled rotary knob, or the linear position of a user-controlled slider. In that case, in the above paragraphs and FIGS. 7-8 that describe the power-distribution scheme, the term "user-interface indication" would replace the terms "segment duration" and "Input Parameter Value". And the upper and lower ranges would be ranges of user-interface indication (instead of ranges of segment duration).

In the above examples, the characteristic value (segment duration or voltage) of the supply power is selected manually (i.e., by a user). In another example, the characteristic value is selected in an automated fashion by a logic device, such as a microprocessor-based device (e.g., computer), that determines what value the supply power characteristic should have based on a program or sensors. For example, the logic device might raise the value of the supply power characteristic (to raise brightness and CCT) when a sensor determines that a person has entered the room and might lower the value of the supply power characteristic (to lower brightness and CCT) when the sensor determines that the person has left the room. FIG. 9 is a block diagram of the lighting device 1 of FIG. 1. The blocks in FIG. 9 can represent physical sub-circuit blocks of the controller's circuitry, and can also represent functional blocks of a method performed by the controller 20. The arrows in FIG. 9 indicate the direction that logic signals flow.

In FIG. 9, the dimmer 10 receives mains high-voltage (e.g., 120V) AC power and outputs segmented high-voltage AC. The controller 20 includes AC/DC converter block 21, which converts the segmented high-voltage AC (received from the dimmer) to high-voltage DC. Voltage-divider block 22 resister-divides the high-voltage DC to a yield a low-voltage DC signal. Voltage-reference block 23 compares the low-voltage DC signal to a reference voltage to determine whether the input power is in the higher range or the lower range. DC/DC block 24 reduces the high-voltage DC to low-voltage DC power appropriate for powering the LEDs. First power-adjustment blocks 26 controls current and/or power flowing through the first light-emitting device L1 (higher-CCT string of LEDs) in accordance with the power-distribution. Second power-adjustment block 27 controls current and/or power flowing through the second light-emitting device L2 (lower-CCT string of LEDs) in accordance with the power-distribution scheme. Constant-current block 28 ensures that total current and/or total power applied to both LED strings remains constant when input power is in the first range.

The components and procedures described above provide examples of elements recited in the claims. They also provide examples of how a person of ordinary skill in the art can make and use the claimed invention. They are described here to provide enablement and best mode without imposing limitations that are not recited in the claims. In some instances, in the above description, a term is followed by a substantially equivalent term or an alternative term enclosed in parentheses.

The invention claimed is:

1. An apparatus comprising:

a controller configured to provide power to:

a first light-emitting device that is configured to emit a first white light of a first correlated color temperature (CCT);

a second light-emitting device that is configured to emit a second white light of a second CCT that is lower than the first CCT, for the first white light to mix with the second white light to yield a combined white light having a combined-light CCT with a combined-light brightness;

receive electrical input supply power in the form of segments of power; and distribute the input supply power to the first and second light-emitting devices according to a power-distribution scheme that differentiates between whether segment duration of the segments is in an upper range or a lower range such that:

throughout the upper range: as the segment duration decreases, the combined-light CCT decreases and the combined-light brightness remains substantially constant, and throughout the lower range: as the segment duration decreases, the combined-light brightness decreases.

2. The apparatus of claim 1, wherein the power-distribution scheme further differentiates between whether segment duration is in an upper portion of the lower range or a lower portion of the lower range such that:

throughout the upper portion of the lower range: as the segment duration decreases, the first brightness decreases, the second brightness remains constant, and the combined-light CCT decreases, and throughout the lower portion of the lower range: as the segment duration decreases, the first brightness remains constant, and the second brightness decreases, and the combined-light CCT remains constant.

3. The apparatus of claim 1, wherein electrical currents applied by the controller to the first and second light-emitting devices are respectively first current and second current;

the sum of the first and second currents is combined current; and the power-distribution scheme further includes:

throughout the upper range: as the segment duration decreases, the first current decreases, the second current increases, and the combined current remains constant, and throughout the lower range: as the segment duration decreases, the combined current decreases.

4. The apparatus of claim 3, wherein the power-distribution scheme further differentiates between whether the segment duration is in an upper portion of the lower range or a lower portion of the lower range such that:

throughout the upper portion of the lower range: as the segment duration decreases, the first current decreases, and the second current remains constant, and throughout the lower portion of the lower range: as the segment duration decreases, the first current remains constant, and the second current decreases.

5. The apparatus of claim 1, wherein electrical powers applied by the controller to the first and second light-emitting devices are respectively first power and second power;

the sum of the first and second powers is combined power; and the power-distribution scheme further includes:

throughout the upper range: as the segment duration decreases, the first power decreases, the second power increases, and the combined power remains constant, and throughout the lower range: as the segment duration decreases, the combined power decreases.

6. The apparatus of claim 5, wherein the power-distribution scheme further differentiates between whether the segment duration is in an upper portion of the lower range or a lower portion of the lower range such that:

throughout the upper portion of the lower range: as the segment duration decreases, the first power decreases, and the second power remains constant, and throughout the lower portion of the lower range: as the segment duration decreases, the first power remains constant, and the second power decreases.

7. The apparatus of claim 1, wherein the lower range is contiguous with the upper range.

8. The apparatus of claim 1, wherein the segments are segments of an alternating current (AC) wave, such that the duration corresponds to an angular range over which each segment extends.

9. The apparatus of claim 1, further comprising:

the first and second light-emitting devices; and a lamp housing that supports the first and second light-emitting devices in positions relative to each other such that the first white light will mix with the second white light to yield the combined white light.

10. The apparatus of claim 9, wherein the first light-emitting device comprises one or more LEDs, and the second light-emitting device comprises one or more LEDs.

11. The apparatus of claim 1, wherein:

the first CCT is in the range 4000K to 7000K, the second CCT is in the range 1500K to 3000K, and the combined-light CCT is:

in the range 4500K to 6500K when the segment duration is at a top of the upper range, in the range 2500K to 3500K when the segment duration is at the bottom of the upper range and the top of the lower range, and in the range 1500K to 2500K when the segment duration is at a bottom of the lower range.

12. The apparatus of claim 1, further comprising a dimmer that is configured to provide the input supply power to the controller and that includes a user-interface component through which a user can adjust the segment duration of the input supply power.

13. The apparatus of claim 12, wherein the user-interface component is a physical component that is configured to be manually moved by a user to adjust the segment duration.

14. The apparatus of claim 12, wherein the lamp housing is in the form of a canister light fixture for recessed lighting, and the user-interface component is located at a top of the lamp housing which is configured to be hidden behind a surface of a ceiling when the lamp housing is mounted in the ceiling.

15. A method for powering a (i) first light-emitting device configured to emit a first white light of a first correlated color temperature (CCT) and (ii) a second light-emitting device configured to emit a second white light of a second CCT with a second brightness, wherein the second CCT is lower than the first CCT, for the first white light to mix with the second white light to yield a combined white light having a combined-light CCT with a combined-light brightness, the method comprising:

receiving electrical input power in the form of segments of an alternating current (AC) wave; and distributing the input supply power to the first and second light-emitting devices according to a power-distribution scheme that differentiates between whether segment duration of the segments is in an upper range or a lower range such that:

throughout the upper range: as the segment duration decreases, the combined-light CCT decreases and the combined-light brightness remains substantially constant, and throughout the lower range: as the segment duration decreases, the combined-light brightness decreases.

16. The method of claim 15, wherein the power-distribution scheme further differentiates between whether segment duration is in an upper portion of the lower range or a lower portion of the lower range such that:

throughout the upper portion of the lower range: as the segment duration decreases, the first brightness decreases, the second brightness remains constant, and the combined-light CCT decreases, and throughout the lower portion of the lower range: as the segment duration decreases, the first brightness remains constant, and the second brightness decreases, and the combined-light CCT remains constant.

17. The method of claim 15, wherein electrical current applied by the controller to the first and second light-emitting devices are respectively first current and second current;

the sum of the first and second currents is combined current; and the power-distribution scheme further includes:

throughout the upper range: as the segment duration decreases, the first current decreases, the second current increases, and the combined current remains constant, and throughout the lower range: as the segment duration decreases, the combined current decreases; and the power-distribution scheme further differentiates between whether the segment duration is in an upper portion of the lower range or a lower portion of the lower range such that:

throughout the upper portion of the lower range: as the segment duration decreases, the first current decreases, and the second current remains constant, and throughout the lower portion of the lower range: as the segment duration decreases, the first current remains constant, and the second current decreases.

18. The method of claim 15, wherein electrical current applied by the controller to the first and second light-emitting devices are respectively first power and second power;

the sum of the first and second currents is combined power; and the power-distribution scheme further includes:

throughout the upper range: as the segment duration decreases, the first power decreases, the second power increases, and the combined power remains constant, and throughout the lower range: as the segment duration decreases, the combined power decreases; and the power-distribution scheme further differentiates between whether the segment duration is in an upper portion of the lower range or a lower portion of the lower range such that:

throughout the upper portion of the lower range: as the segment duration decreases, the first power decreases, and the second power remains constant, and throughout the lower portion of the lower range: as the segment duration decreases, the first power remains constant, and the second power decreases.

19. A can light fixture for recessed lighting, comprising:

a first LED device that is configured to emit a first white light of a first correlated color temperature (CCT) in the range 4000K to 7000K;

a second LED device that is configured to emit a second white light of a second CCT in the range 1500K to 3000K;

a lamp housing that supports the first and second light-emitting devices in positions relative to each other such that the first white light will mix with the second white light to yield combined white light of a combined-light CCT having combined-light brightness, and is configured to be installed in a ceiling as a recessed can light fixture;

a user-interface component through which a user can select a user-interface value; and a controller that is configured to:

distribute the input supply power to the first and second light-emitting devices according to a power-distribution scheme that differentiates between whether the user-interface value is in an upper range or a lower range such that:

throughout the upper range: as the user-interface value decreases, the combined-light CCT decreases and the combined-light brightness remains substantially constant, and throughout the lower range: as the user-interface value decreases, the combined-light brightness decreases.

20. The apparatus of claim 19, wherein the power-distribution scheme further differentiates between whether segment duration is in an upper portion of the lower range or a lower portion of the lower range such that:

throughout the upper portion of the lower range: as the segment duration decreases, the first brightness decreases, the second brightness remains constant, and the combined-light CCT decreases, and throughout the lower portion of the lower range: as the segment duration decreases, the first brightness remains constant, and the second brightness decreases, and the combined-light CCT remains constant.

* * * * *